United States Patent [19]

Heubner et al.

[11] Patent Number: 4,906,437

[45] Date of Patent: Mar. 6, 1990

[54] CORROSION RESISTANT HOT AND COLD FORMING PARTS OF NI-CR-MO ALLOY AND METHOD OF MAKING SAME

[75] Inventors: Ulrich Heubner, Werdohl; Michael Köhler, Oberursel; Manfred Rockel, Friedrichsdorf; Ernst Wallis, Eschborn, all of Fed. Rep. of Germany

[73] Assignee: VDM Nickel-Technologie Aktiengesellschaft, Werdohl, Fed. Rep. of Germany

[21] Appl. No.: 313,622

[22] Filed: Feb. 21, 1989

[30] Foreign Application Priority Data

Mar. 3, 1988 [DE] Fed. Rep. of Germany ..... 3806799

[51] Int. Cl.[4] ..... C22C 19/05

[52] U.S. Cl. ..... 420/443; 148/11.5 N; 148/428

[58] Field of Search ..... 420/443; 148/11.5 N, 148/428

[56] References Cited

U.S. PATENT DOCUMENTS 3,650,734 3/1972 Kantor ..... 420/443
4,129,464 12/1978 Matthews ..... 148/162

FOREIGN PATENT DOCUMENTS 0178785 4/1986 European Pat. Off. .
3125301 3/1982 Fed. Rep. of Germany .

OTHER PUBLICATIONS

Chemical Abstracts vol. 104, 1986 p. 312, 104:153929a.
Chemical Abstracts vol. 102, 1985, p. 254, 102:170738p.

*Primary Examiner*—R. Dean
*Attorney, Agent, or Firm*—Herbert Dubno

[57] ABSTRACT

For use in making components which are required to have a very high resistance to uniform corrosion and against pitting and crevice corrosion under very highly corrosive conditions encountered in up to date chemical process technology and environmental protection technology, for instance, in flue gas desulfurizing plants for concentrating sulfuric acid, and which are required to be manufactured satisfactorily by conventional hot and cold forming processes an alloy is employed which contains (in % by weight) 22.0 to 24.0 chromium, 15.0 to 16.5 molybdenum, up to 0.3% tungsten, up to 1.5% iron, up to 0.4% vanadium, 0.1 to 0.4% aluminum, 0.001 to 0.04% magnesium and 0.001 to 0.01 calcium, balance nickel and inevitable accompanying elements and impurities.

14 Claims, No Drawings

CORROSION RESISTANT HOT AND COLD FORMING PARTS OF NI-CR-MO ALLOY AND METHOD OF MAKING SAME

FIELD OF THE INVENTION

Our present invention relates to an improved NiCrMo alloy and to the method of making components which are required to have a very high resistance to ablative corrosion and against pitting and crack corrosion under very highly corrosive conditions encountered in modern chemical process technology, for instance, in flue gas desulfurizing plants or in plants for concentrating sulfuric acid, the parts of which are required to be manufactured satisfactorily by conventional hot and cold forming processes.

BACKGROUND OF THE INVENTION

In German Patent Publication 1,210,566 and in the corresponding U.S. Pat. No. 3,203,792 and in French Patent 1,536,741, the following alloys containing nickel, chromium and molybdenum as main components have been disclosed (all % by weight):

| German Patent Publication 1,210,566 U.S. Pat. No. 3,203,792 | French Patent 1,536,741 |
|---|---|
| 14 to 16% chromium | 14.5 to 23% chromium |
| 3 to 18% molbdenum | 14 to 17% molbdenum |
| up to 5% tungsten | up to 5% tungsten |
| up to 50% cobalt | up to 2.5% cobalt |
| up to 0.1% carbon | up to 0.03% carbon |
| up to 0.2% silicon | up to 0.05% silicon |
| up to 3% manganese | up to 1% manganese |
| up to 30% iron | up to 7% iron |
| 40 to 65% nickel | up to 0.35% vanadium |
| | balance nickel |

It is also known that such alloys cannot be processed satisfactorily if they contain additional reactive elements as deoxidizers.

For instance, from Z. Metallkunde, Volume 53 (1962), page 289, such alloys can be forged satisfactorily only if they contain 0.16 to 0.71% aluminum or 0.09 to 0.11% magnesium.

In accordance with German Patent Publication 1,210,566 and the corresponding U.S. Pat. No. 3,203,792, stemming from the same source as the article in Z. Metallkunde aluminum has proved to be highly undesirable as a deoxidizer whereas additions of alkaline earth metal, i.e. magnesium or calcium, are apparently suitable.

OBJECTS OF THE INVENTION

It is the principal object of the present invention to provide an improved Ni-Cr-Mo alloy which can be readily formed by conventional hot and cold forming techniques and will have better corrosion resistance than earlier compositions, especially resistance to acids and, most particularly, sulfuric acid and hydrochloric acid, so as to allow processing equipment made from the alloy to be used effectively in the handling of sulfuric acid in flue gas desulfurization and in corrosive biotechnology environments.

Another object of the invention is to provide an improved method of making processing equipment and processing plant components which will yield products of lower susceptibility to corrosion, especially in acid environments and for the above-mentioned types of equipment.

It is also an object of our invention to provide improved processing plant equipment which is less susceptible to corrosion than equipment made from earlier Ni-Cr-Mo alloys.

SUMMARY OF THE INVENTION

We have discovered, quite surprisingly, that a narrow class of Ni-Cr-Mo alloys can be made which will have an unexpectedly high resistance to corrosion in acid environments and yet can be easily formed by conventional hot and cold forming techniques into processing equipment such as tanks, vats, troughs, hoods, scrubbers, pipelines, condensers, boilers, evaporators and sludge-processing and drying apparatus so that, especially in the fields of sulfuric acid concentration, flue gas desulfurizing and biotechnology, problems which have developed with earlier Ni-Cr-Mo alloys can be obviated.

Essentially, the composition consists of (all % by weight):

22.0 to 24.0% chromium
15.0 to 16.5% molybdenum
up to 0.3% tungsten
up to 1.5% iron
up to 0.3% cobalt
up to 0.1% silicon
up to 0.5% manganese
up to 0.015% carbon
up to 0.4% vanadium
0.1 to 0.4% aluminum
0.001 to 0.04% magnesium
0.002 to 0.01% calcium
balance nickel and inevitable impurities.

It has surprisingly been found that the best hot workability without any cracks which will be achieved when the deoxidizing elements aluminum, magnesium and calcium are used in the following combination (% by weight):

0.1 to 0.4% aluminum
0.001 to 0.04% magnesium
0.001 to 0.01% calcium and that the contents of magnesium and calcium may be below the lower limits in electric slag refining. But all three elements must be used in combination and do not constitute optional or replaceable components, as is taught, e.g. in U.S. Pat. No. 4,129,464.

As has been noted, a variety of compositions containing nickel, chromium and molybdenum have been disclosed in the art with rather broad ranges of the various components and it is indeed surprising that even within these ranges, there may exist compositions with a narrower set of ranges which are markedly superior for the fabrication of processing equipment in the specific fields mentioned, namely, the concentration of sulfuric acid, flue gas desulfurization and biotechnology.

For applications in various highly corrosive media an alloy having the following composition (% by weight) has been disclosed in Published German Application 31 25 301:

20 to 24% chromium
12 to 17% molybdenum
2 to 4% tungsten
less than 0.5% niobium
less than 0.5% tantalum
less than 0.1% carbon
less than 0.2% silicon less than 0.5% manganese
2 to 8% iron
less than 0.7% aluminum and titanium
less than 0.5% vanadium At the time when that alloy became known and was introduced into the market, it had among the alloys which were then available, the optimum combination of corrosion-resisting properties. But in trials for uses encountered in modern chemical process technology and modern environmental protection technology, it has been found that the alloy does not meet all requirements.

For instance, the progressively increasing demands for environmental protection prohibit dumping of waste sulfuric acid, so-called dilute acid, so that such waste sulfuric acid must be processed. For such processing, materials are required for the tanks, stills and piping which have a particularly high resistance to corrosion by contaminated sulfuric acid of medium concentration.

Of course, in each of the fields to which the invention is applicable, the alloy of the invention should be utilized for all structures which ultimately come into contact with the corrosive media. While only some equipment of this type has been named, the ordinary skilled worker in the art familiar with the processing plants involved will readily recognize these elements which of necessity, come into contact with the corrosive medium. Moreover, it has been found in connection with the increasing use of flue gas desulfurization, that the conditions encountered therein may be so highly aggressive that the alloys used for that purpose heretofore, can no longer be safely used. This is because the scrubbing water is recirculated so that the water is removed from that cycle only at a low rate so that the water becomes highly enriched with chloride ions in particular.

Because the demand for environmental protection prohibits operation of a fossil-fuel power plant unless the flue gas desulfurizing plant is operative, the materials used for that purpose, e.g. for the pipelines, scrubbers, cyclones and electrostatic precipitators, must have a higher resistance to corrosion than those which have been known in the art heretofore.

We have found that the specific alloy described above can be fabricated by conventional hot and cold forming techniques, including rolling, drawing, stamping and conventional fabrication by appropriate welding steps, riveting and seaming into the scrubbers, pipelines, sludge processing basins, electrostatic precipitator, cyclone and other dust-collector housings and the like and will have the surprisingly higher resistance to corrosion than the articles fabricated from the compositions used heretofore.

Another example which may be mentioned for the use of the materials of the invention relates to the high requirements to be met by materials used in biotechnology. In that case, hydrochloric acid, which is the only mineral acid that is compatible with the human and animal body, is of great significance. The new materials also have a high resistance to dilute hydrochloric acid.

It is thus a more detailed object to provide an alloy which can be economically produced and processed and which can be used under the novel operating conditions encountered in up to date chemical process technology and modern environmental protection technology and which, as regards the novel requirements for corrosion resistance, is distinctly superior to alloys of the type described in Published German Application 31 25 301.

According to another feature or aspect of the invention, an alloy having the following composition (all % by weight):

22.0 to 24.0% chromium
15.0 to 16.5% molybdenum
up to 0.3% tungsten
up to 1.5% iron
up to 0.3% cobalt
up to 0.1% silicon
up to 0.5% manganese
up to 0.015% carbon
up to 0.4% vanadium
0.1 to 0.4% aluminum
0.001 to 0.04% magnesium
0.001 to 0.01% calcium balance nickel and inevitable impurities, is used in the fabrication by hot or cold forming of components required to have a very high resistance to ablative corrosion and to pitting and crack corrosion under highly corrosive conditions in a flue gas desulfurizing, sulfuric acid concentrating or biotechnology plant.

SPECIFIC DESCRIPTION

From the test results stated in the accompanying tables 1 to 7, it is apparent that the last-mentioned alloy has under all test conditions, a distinctly higher resistance to corrosion than corresponds to the Published German Application 31 25 301.

The test results have been obtained from Examples 1 to 4 of the alloy in accordance with the invention. The chemical analyses of said Examples are stated in Table 1, in which the analyses of the Control Examples 5 and 6 are also given. The Control Examples correspond to the Published German Application 31 25 301 and made with workability-determining contents of aluminum, magnesium and calcium in the ranges in accordance with the invention.

The test solution used for testing equipment for concentrating dilute sulfuric acid may consist of a boiling aqueous solution that contains 23% $H_2SO_4$, 1.2% HCl, 1% $FeCl_3$ and 1% $CuCl_2$, as specified in ASTM G-28 for Method B.

As is apparent from Table 2, the alloy in accordance with the invention has a corrosion rate which is lower by 30% than the alloy of the prior art. If the prior art is evaluated with reference to the value of 0.17 mm/year stated in "Werkstoffe und Korrosion", Volume 37 (1986), pages 137 to 145, rather than with reference to the measurements made in connection with the invention as stated for the Control Example 6 in Table 2, it will be apparent that the corrosion resistance of the alloy in accordance with the invention exceeds that of the prior art composition by as much as 59%.

More highly diluted sulfuric acids which contain chloride ions are often used to determine the resistance to local corrosion by a measurement of the critical temperature for pitting corrosion under such conditions. In such tests, the alloy in accordance with the invention has proved to be substantially equivalent to that of the prior art, as is apparent from Table 3.

The critical temperature for pitting corrosion determined for the prior art is the value that has been stated in "Werkstoffe und Korrosion", Volume 37 (1986), pages 137 to 145. From the results of the measurements obtained from Examples 3 and 4 it is apparent that the alloy in accordance with the invention is slightly superior.

The values stated in the same Table for the resistance of the prior art alloy to local corrosion in 10% $FeCl_3.6H_2O$ are identical, but this is only due to the fact that a measurement at a higher temperature is not possible under the test conditions so that the "higher than" symbol must be used in both cases.

On the other hand, it is apparent from Table 4 that the alloy in accordance with the invention is clearly superior to that of the prior art as regards the susceptibility to crack corrosion in the same solution at 85° C. when the measurements had been taken in a conventional crack-forming fixture comprising a block of PTFE (see "Werkstoffe und Korrosion", Volume 37 (1986), page 185).

In view of the requirements to be met in the desulfurization of flue gases, the higher resistance of the alloy in accordance with the invention is of high significance and is apparent from Table 4. For this reason, the alloy in accordance with the invention may be used in cases for which the prior art alloy is no longer suitable owing to the increase of local corrosion, e.g. in prescrubbers operating under particularly aggressive conditions. Aside from this, Table 5 indicates the linear corrosion rates in typical media used for flue gas desulfurization and it is apparent that the alloy in accordance with the invention gives much better results, particularly in dilute 2% sulfuric acid solution at a high temperature (105° C.) if the solution has a high chloride content. In that case, the average corrosion rate is lower by about 53% than that of the prior art alloy.

The higher resistance of the alloy in accordance with the invention to corrosion in dilute hydrochloric acid compared to the prior art is apparent from Table 6. In accordance therewith, the alloy in accordance with the invention is superior by 60% to the Control Examples of the prior art.

A substantial improvement by about 25% will even be achieved in case of a comparison with the corrosion rate of 0.28 mm/year, which has been published (in "Werkstoffe und Korrosion", Volume 37, (1986), pages 137 to 144) for the prior art.

In addition, Table 6 contains data for the resistance to corrosion in a chloride-free 10% $H_2SO_4$, which is another important reducing acid. In that case, the corrosion rate is about 64% lower than that of the prior art and is still lower by 50% than the value of 0.36 mm/year stated for the prior art in Published German Application 31 25 201.

It is also surprising that even in oxidizing media, such as in the test solution specified in ASTM G-28 for Method A and used as a standard test solution for highly oxidizing conditions, the corrosion resistance of the alloy in accordance with the invention is distinctly higher, i.e. by 40%, than that of the prior art as is apparent from Table 7.

In the latter case, the corrosion rate measured for the prior art is higher than the value of 0.74 mm/year as stated in Published German Application 31 25 101, an amount, on an average, of 0.91 mm/year. But even in view of the lower value stated for the prior art, the alloy in accordance with the invention results in a considerable improvement of 26% over the prior art.

The superior performance of the alloy in accordance with the invention compared to the prior art is particularly remarkable because Published German Application 31 25 301 teaches that tungsten and iron must be added in an amount of at least 2% each and certain ratios Mo/W and Fe/W must be established. But tungsten will not be used as an alloying element unless certain other materials are not available. In conjunction with the known alloy it has been emphasized that the two elements are required in the stated ranges and the ratio of Mo to W must be in the range from 3 to 5. In view of that background, it was not obvious to the ordinary skilled worker in the art that an alloy for use in the stated field of application may be selected which contains tungsten only in quantities which are inevitable in an economical production with use of recycled scrap and that such amount will not adversely affect the processing properties of the alloy.

As the Tables and the foregoing description show, the alloy of the invention is particularly effective in the fabrication of components which can have high resistance to corrosion under ASTM G-28 method B.

The components are capable of withstanding concentrations of 60% sulfuric acid with a chloride ion content of 15 g/l at a temperature of 80° C. with a significantly lower corrosion rate than that of the alloy described in German Published Application 31 25 301.

It is also more resistant to corrosion in dilute sulfuric acid having a high chloride concentration of the type generated in gas desulfurizing plants, (e.g. 2% sulfuric acid and a chloride ion content of 70 g/l at 105° C.).

TABLE 1

Examples of the alloy in accordance with the invention in accordance with the invention and of prior art alloys (P.A.). The chemical compositions are stated in % by weight. The nickel content was determined as the balance to 100%.
Invention: Examples 1 to 4
Prior art: Control Examples 5 and 6

| No. | Ni | Cr | Mo | W | Fe | Si | Mn | C | Al | Mg | Ca | V |
|---|---|---|---|---|---|---|---|---|---|---|---|---|
| 1 | 60.5 | 22.4 | 15.5 | 0.10 | 0.85 | 0.08 | 0.21 | 0.008 | 0.19 | 0.001 | 0.001 | 0.14 |
| 2 | 59.7 | 23.2 | 15.5 | 0.10 | 0.81 | 0.08 | 0.21 | 0.008 | 0.20 | 0.001 | 0.001 | 0.14 |
| 3 | 59.4 | 22.5 | 16.4 | 0.10 | 0.92 | 0.09 | 0.20 | 0.011 | 0.19 | 0.001 | 0.001 | 0.14 |
| 4 | 58.5 | 23.4 | 16.5 | 0.10 | 0.82 | 0.09 | 0.21 | 0.008 | 0.22 | 0.003 | 0.002 | 0.13 |
| 5 | 58.9 | 21.5 | 13.2 | 2.90 | 2.77 | 0.05 | 0.15 | 0.008 | 0.25 | 0.001 | 0.002 | 0.18 |
| 6 | 58.9 | 21.2 | 14.0 | 2.80 | 2.37 | 0.10 | 0.20 | 0.010 | 0.23 | 0.003 | 0.002 | 0.14 |

TABLE 2

| Test conditions | | Corrosion rate in mm/year | | | | | |
|---|---|---|---|---|---|---|---|
| | | P.A. | Invention | | | | Difference |
| Solution containing 23% $H_2SO_4$, 1.2% HCl, 1% $FeCl_3$, 1% $CuCl_2$, boiling | Example No. | 6 | 1 | 2 | 3 | 4 | |
| | Individual | 0.10 | 0.06 | 0.07 | 0.08 | 0.06 | |

TABLE 2-continued

| Test conditions | | Corrosion rate in mm/year P.A. | Invention | Difference |
|---|---|---|---|---|
| | values | | | |
| (ASTM G-28, Method B) | Average | 0.10 | 0.07 | 30% |

TABLE 3

| Test conditions | | Critical temperature for pitting corrosion, °C. P.A. | | | Invention | | |
|---|---|---|---|---|---|---|---|
| Solution containing 7% $H_2SO_4$, 3% HCl, 1% $FeCl_3$ and 1% $CuCl_2$, for 24 hours | Example No. | 5 | 6 | 1 | 2 | 3 | 4 |
| | Individual values | 120 | 120 | 120 | 120 | 120 | >120 |
| | | | | | | >120 | |
| 10% $FeCl_3.6\ H_2O$ solution, for 72 hours | Example No. | 5 | 6 | 1 | 2 | 3 | 4 |
| | Individual values | 85 | | | | 85 | |

TABLE 4

| Test conditions | | Susceptibility to crevice corrosion(+) P.A. | | | Invention | | | Difference |
|---|---|---|---|---|---|---|---|---|
| 10% $FeCl_3.6\ H_2O$ solution at 85° C., for 72 hours | Example No. | 5 | 6 | 1 | 2 | 3 | 4 | |
| | Individual values | 0.77 | 0.75 | 0.23 | 0.08 | 0.06 | 0 | |
| | Average | 0.76 | | | 0.09 | | | 88% |

(+)Number of crevices exhibiting corrosion divided by the total number of crevices (48)

TABLE 5

| Test conditions | | Corrosion rates in mm/year P.A. | | | Invention | | | Difference |
|---|---|---|---|---|---|---|---|---|
| 60% $H_2SO_4$ containing 15 g/l $Cl^-$, 80° C. | Example No. | 5 | 6 | 1 | 2 | 3 | 4 | |
| | Individual values | 0.32 | 0.30 | 0.25 | 0.28 | 0.26 | 0.27 | |
| 14 days | Average | 0.31 | | | 0.27 | | | 13% |
| 2% $H_2SO_4$ plus 70 000 ppm $Cl^-$ | Example No. | 5 | 6 | 1 | 2 | 3 | 4 | |
| | Individual values | 0.08 | 0.04 | 0.004 | 0.012 | 0 | 0 | |
| 105° C., 21 days | Average | 0.06 | | | 0.004 | | | 93% |

TABLE 6

| Test conditions | | Corrosion rates in mm/year P.A. | | | Invention | | | Difference |
|---|---|---|---|---|---|---|---|---|
| 1.5% HCl, boiling, for 14 days | Example No. | 5 | 6 | 1 | 2 | 3 | 4 | |
| | Individual values | 0.59 | 0.47 | 0.22 | 0.25 | 0.22 | 0.16 | |
| | Average | 0.52 | | | 0.21 | | | 60% |
| 10% $H_2SO_4$, boiling, for 14 days | Example No. | 5 | 6 | 1 | 2 | 3 | 4 | |
| | Individual values | 0.52 | 0.31 | 0.17 | 0.14 | 0.18 | 0.12 | |
| | Average | 0.42 | | | 0.15 | | | 64% |

TABLE 7

| Test conditions | | Corrosion rates in mm/year P.A. | | | Invention | | | Difference |
|---|---|---|---|---|---|---|---|---|
| Solution containing 50% $H_2SO_4$ and 42 g/l | Example No. | 5 | 6 | 1 | 2 | 3 | 4 | |
| | Individual values | 0.93 | 0.88 | 0.54 | 0.51 | 0.61 | 0.53 | |
| $Fe_2(SO_4)_3$, boiling, for 120 hours (ASTM G-28 Method A) | Average | 0.91 | | | 0.55 | | | 40% |

We claim:

1. A nickel-chromium-molybdenum alloy consisting essentially of:

22.0 to 24.0% chromium
15.0 to 16.5% molybdenum
up to 0.3% tungsten
up to 1.5% iron
up to 0.3% cobalt
up to 0.1% silicon
up to 0.5% manganese
up to 0.015% carbon
up to 0.4% vanadium 0.1 to 0.4% aluminum
0.001 to 0.04% magnesium
0.002 to 0.01% calcium
balance nickel and inevitable impurities.

2. A method of making a component required to have a very high resistance to ablative corrosion and against pitting and crack corrosion under very highly corrosive conditions, in a flue gas desulfurizing plant for concentrating sulfuric acid or a biotechnology plant by a hot or cold forming process, comprising the steps of:
(a) forming an alloy as defined in claim 1; and
(b) fabricating said component therefrom.

3. A method of making a component of a plant for contact with a chloride ion-containing hot sulfuric acid having a medium to moderately high concentration, such as is obtained in a flue gas desulfurizing plant and including 60% sulfuric acid having a chloride ion concentration of 15 g/l and a temperature of 80° C., comprising the steps of:
(a) forming an alloy as defined in claim 1; and
(b) fabricating said component therefrom.

4. A method of making a component of a plant for contact with a dilute sulfuric acid having a high chloride ion concentration, such as is obtained in a flue gas desulfurizing plant and including 2% sulfuric acid having a chloride ion concentration of 70 g/l at 105° C., comprising the steps of:
(a) forming an alloy as defined in claim 1; and
(b) fabricating said component therefrom.

5. A method of making a component of a plant for contact with a chloride ion-containing hot sulfuric acid having a low to medium concentration and in the simultaneous presence of strongly oxidizing admixtures as occurs in a plant for concentrating sulfuric acid and corresponding in corrosivity to a boiling testing medium containing 23% $H_2SO_4$, 1.2% HCl, 1% $FeCl_3$, 1% $CuCl_2$, comprising the steps of:
(a) forming an alloy as defined in claim 1; and
(b) fabricating said component therefrom.

6. A method of making a component of a plant for contact with a sulfuric acid solution under conditions encountered in the concentration of dilute waste sulfuric acid corresponding to the test in accordance with ASTM G-28, Method B, comprising the steps of:
(a) forming an alloy as defined in claim 1; and
(b) fabricating said component therefrom.

7. A method of making a component which in a solution of 7% $H_2SO_4$, 3% HCl, 1% $FeCl_3$ and 1% $CuCl_2$ for a testing time of 24 hours has a critical temperature for pitting corrosion of at least 120° C., comprising the steps of:
(a) forming an alloy as defined in claim 1; and
(b) fabricating said component therefrom.

8. A method of making a component which in a 10% solution of $FeCl_3.6H_2O$ during a testing time of 72 hours has a critical temperature for pitting corrosion in excess of 85° C. and a low to negligible susceptibility to crack corrosion at 85° C., comprising the steps of:
(a) forming an alloy as defined in claim 1; and
(b) fabricating said component therefrom.

9. A method of making a component which in highly corrosive, reducing hot acid solutions has a very high resistance to corrosion including resistance to boiling 1.5% HCl solution corresponding to an average corrosion rate of 0.21 mm/year, comprising the steps of:
(a) forming an alloy as defined in claim 1; and
(b) fabricating said component therefrom.

10. A method of making a component which in highly corrosive reducing hot acid solutions including boiling 10% $H_2SO_4$ solution, has a high resistance to corrosion corresponding to an average corrosion rate of about 0.15 mm/year, comprising the steps of:
(a) forming an alloy as defined in claim 1; and
(b) fabricating said component therefrom.

11. A method of making a component which under oxidizing acid solutions undergoes only a slight ablative corrosion in a medium including a boiling aqueous solution containing 50% $H_2SO_4$ and 42 g/l $Fe_2(SO_4)_3$, comprising the steps of:
(a) forming an alloy as defined in claim 1; and
(b) fabricating said component therefrom.

12. In a method of operating a flue gas desulfurizing, a sulfuric acid concentrating or biotechnology plant in which a corrosive medium is contacted with processing plant equipment, the improvement which comprises the step of making, said equipment from an alloy which has been hot or cold formed and consists of (all % by weight):
22.0 to 24.0% chromium
15.0 to 16.5% molybdenum
up to 0.3% tungsten
up to 1.5% iron
up to 0.3% cobalt
up to 0.1% silicon
up to 0.5% manganese
up to 0.015% carbon
up to 0.4% vanadium
0.1 to 0.4% aluminum
0.001 to 0.04% magnesium
0.002 to 0.01% calcium
balance nickel and inevitable impurities.

13. A method of making a component of process plant equipment for use in a flue gas desulfurizing, sulfuric acid concentrating or biotechnology plant which comprises hot or cold forming said component from an alloy consisting of (all % by weight):
22.0 to 24.0% chromium
15.0 to 16.5% molybdenum
up to 0.3% tungsten
up to 1.5% iron
up to 0.3% cobalt
up to 0.1% silicon
up to 0.5% manganese
up to 0.015% carbon
up to 0.4% vanadium
0.1 to 0.4% aluminum
0.001 to 0.04% magnesium
0.002 to 0.01% calcium
balance nickel and inevitable impurities.

14. A plant for the desulfurizing of a flue gas, for the concentration of sulfuric acid or for biotechnology which comprises means for handling a corrosive medium and at least one piece of equipment contacted by said medium and formed from the alloy defined in claim 1.

* * * * *